US012465808B2

(12) United States Patent
Chen et al.

(10) Patent No.: US 12,465,808 B2
(45) Date of Patent: Nov. 11, 2025

(54) FOLDABLE TREADMILL

(71) Applicant: XIAMEN MYDO SPORTS EQUIPMENT CO., LTD., Fujian (CN)

(72) Inventors: Jinshui Chen, Fujian (CN); Bingwen Liu, Fujian (CN)

(73) Assignee: XIAMEN MYDO SPORTS EQUIPMENT CO., LTD., Fujian (CN)

( * ) Notice: Subject to any disclaimer, the term of this patent is extended or adjusted under 35 U.S.C. 154(b) by 58 days.

(21) Appl. No.: 18/587,984

(22) Filed: Feb. 27, 2024

(65) Prior Publication Data

US 2024/0198173 A1 Jun. 20, 2024

(30) Foreign Application Priority Data

Mar. 28, 2023 (CN) ..... 202320638364.7

(51) Int. Cl.
*A63B 22/02* (2006.01)
*A63B 21/00* (2006.01)

(52) U.S. Cl.
CPC ..... *A63B 22/02* (2013.01); *A63B 21/4035* (2015.10); *A63B 2210/52* (2013.01)

(58) Field of Classification Search
CPC . A63B 22/02; A63B 21/4035; A63B 2210/52; A63B 2210/50
See application file for complete search history.

(56) References Cited

U.S. PATENT DOCUMENTS

2002/0000710 A1* 1/2002 Kaneko ..... B62B 7/06 280/647
2006/0040798 A1* 2/2006 Weier ..... A63B 22/02 482/54
2006/0058160 A1* 3/2006 Lee ..... A63B 22/0023 482/54
2007/0066448 A1* 3/2007 Pan ..... A63B 22/0235 482/54

* cited by examiner

*Primary Examiner* — Sahlu Okebato
(74) *Attorney, Agent, or Firm* — Birchwood IP

(57) ABSTRACT

A foldable treadmill having a base and a rotational shaft whose two ends are fixed with supporting posts respectively; handle bars are mounted to top ends of the supporting posts respectively; two seats are fixed on the rotational shaft and correspond to the support posts; one end of each wire is connected with a corresponding handle bar, another end of each wire is connected with a corresponding pin; rotation of the handle bars to achieve folding of the treadmill drives the wires to pull the pins; each seat has a position limiting hole which a corresponding pin is removably inserted, so that the two seats together with the rotational shaft achieve a fixed state or a rotatable state with respect to the base.

13 Claims, 8 Drawing Sheets

FOLDABLE TREADMILL

BACKGROUND OF THE INVENTION

The present invention relates to the technical field of treadmill, and more particularly relates to a foldable treadmill.

Treadmill is a kind of fitness equipment commonly used at home or in gym. Further, treadmill is the most popular choice of fitness equipment for exercising at home. However, a conventional treadmill is very large in size which is not convenient for storage. Accordingly, a kind of foldable treadmill appears on the market, but a prior art foldable treadmill usually requires separate folding operations of the supporting posts and the handle bar(s) respectively, thus not being convenient to use. Hence, a foldable treadmill enabling linked folding operations of the supporting posts and the handle bar(s) is provided, such as the one disclosed in CN211273365U, wherein rotation of a handle bar pulls a steel wire to drive a pin away from a sleeve so that a rotational shaft can be rotated to achieve folding of the supporting posts downward against a base of the treadmill, thus achieving linked folding operations of the supporting posts and the handle bar. However, in this prior art CN patent, stability is poor in that the sleeve is positioned only on a single seat positioned at a middle part of the rotational shaft, resulting in the supporting posts at two ends of the rotational shaft shaking and wobbling when user is using the treadmill, thereby affecting the user's experience.

BRIEF SUMMARY OF THE INVENTION

It is an object of the present invention to provide a foldable treadmill, which has improved stability to ensure stable and reliable structure of the entire treadmill during folding or unfolding.

To achieve the above object, the present invention provides the following technical solutions:

A foldable treadmill, comprising a base, a rotational shaft, two supporting posts, and two handle bars; the rotational shaft is rotationally mounted at a frontal part of the base; the two supporting posts are fixedly connected to two ends of the rotational shaft respectively, and are also positioned on two sides of the base respectively; the two handle bars are hinged with top ends of the two supporting posts respectively; the two handle bars are foldable against the two supporting posts respectively, and the two supporting posts are foldable against the base; the foldable treadmill also comprises two seats and two sets of wire pulling mechanisms; the two seats are fixedly connected to the rotational shaft corresponding to the two supporting posts respectively; the two sets of wire pulling mechanisms comprise two wires and two pins, wherein each of the two sets of wire pulling mechanisms comprises a wire of the two wires and a pin of the two pins; the two pins of the two sets of wire pulling mechanisms are movably disposed at two side rods of the two sides of the base respectively; one end of the wire of one of the two sets of wire pulling mechanisms disposed corresponding to one of the two sides of the base is connected to a corresponding handle bar disposed also corresponding to a same side as said one of the two sides of the base, and another end of the wire of said one of the two sets of wire pulling mechanisms disposed corresponding to said one of the two sides of the base is connected to a corresponding pin disposed also corresponding to the same side as said one of the two sides of the base or to a corresponding pin disposed corresponding to another one of the two sides of the base; rotation of the two handle bars to achieve folding of the treadmill drive the two wires to pull the two pins; each of the two seats is provided with a position limiting hole which a corresponding pin is removably inserted, so that the two seats together with the rotational shaft achieve a fixed state or a rotatable state with respect to the base.

Further, one end of the wire of one of the two sets of wire pulling mechanisms disposed corresponding to a first side of the two sides of the base is connected to a corresponding handle bar disposed also corresponding to the first side of the two sides of the base, and another end of the wire of said one of the two sets of wire pulling mechanisms disposed corresponding to the first side of the two sides of the base is connected to a corresponding pin disposed also corresponding to the first side of the two sides of the base; and one end of the wire of another one of the two sets of wire pulling mechanisms disposed corresponding to a second side of the two sides of the base is connected to a corresponding handle bar disposed also corresponding to the second side of the two sides of the base, and another end of the wire of said another one of the two sets of wire pulling mechanisms disposed corresponding to the second side of the two sides of the base is connected to a corresponding pin disposed also corresponding to the second side of the two sides of the base;

alternatively, one end of the wire of one of the two sets of wire pulling mechanisms disposed corresponding to a first side of the two sides of the base is connected to a corresponding handle bar disposed also corresponding to the first side of the two sides of the base, and another end of the wire of said one of the two sets of wire pulling mechanisms disposed corresponding to the first side of the two sides of the base is connected to a corresponding pin disposed corresponding to a second side of the two sides of the base; and one end of the wire of another one of the two sets of wire pulling mechanisms disposed corresponding to the second side of the two sides of the base is connected to a corresponding handle bar disposed also corresponding to the second side of the two sides of the base, and another end of the wire of said another one of the two sets of wire pulling mechanisms disposed corresponding to the second side of the two sides of the base is connected to a corresponding pin disposed corresponding to the first side of the two sides of the base.

Further, the two sets of wire pulling mechanisms also comprise two wheels and two sleeves, wherein each of the two sets of wire pulling mechanisms comprises a wheel of the two wheels and a sleeve of the two sleeves; the two wheels of the two sets of wire pulling mechanisms are disposed on the two handle bars respectively; the two wheels rotate when the two handle bars rotate; one end of the wire of one of the two sets of wire pulling mechanisms is connected to the wheel of said one of the two sets of wire pulling mechanisms so that the wire is connected to a corresponding handle bar; the two sleeves of the two sets of wire pulling mechanisms are mounted on the two side rods of the two sides of the base respectively; each of the two sleeves is formed with a through hole which aligns with the position limiting hole of a corresponding seat when the treadmill is in an unfolded state; in each of the two sets of wire pulling mechanisms, the pin is reciprocally slidable in the sleeve, and the pin has a position limiting head which is extendable out of the through hole of the sleeve; in each of the two sets of wire pulling mechanisms, an elastic piece is disposed between the pin and the sleeve; the position limiting head of each pin extends out of the through hole of a corresponding sleeve and into the position limiting hole of the corresponding seat when the treadmill is in the unfolded state.

Further, at least one of the two seats is provided with an unfolded state positioning hole; at least one of the two side rods of the base is provided with a fixing groove corresponding to the unfolded state positioning hole; a positioning pin is slidably disposed in the fixing groove; an outer end of the positioning pin has a curved surface; an elastic piece is positioned between the fixing groove and an inner end of the positioning pin; when the treadmill is in an unfolded state, the outer end of the positioning pin is inserted into the unfolded state positioning hole.

Further, the unfolded state positioning hole is provided on said at least one of the two seats at a position corresponding to one side of the rotational shaft where an opposite side of the rotational shaft is disposed with the position limiting hole.

Further, a folded state positioning hole is also disposed on one side of the unfolded state positioning hole; the unfolded state positioning hole and the folded state positioning hole are positioned on said at least one of the two seats at two points on a circular perimeter which has a center of circle being an axis of the rotational shaft; when the treadmill is in a folded state, the folded state positioning hole is aligned with the fixing groove, so that the outer end of the positioning pin extends out of the fixing groove and insert into the folded state positioning hole.

Further, one side of said at least one of the two seats facing towards a front side of the treadmill when the treadmill is in an unfolded state is provided with a limiting plane; the base is provided with a limiting board; when the treadmill is in an unfolded state, the limiting plane abuts against the limiting board.

Further, the limiting board is provided with an adjustment hole; an adjustment screw is threaded to the adjustment hole; one end of the adjustment screw extends out of the adjustment hole and is abuttable against the limiting plane.

Further, each of the two wires passes through thus being at least partially concealed within a corresponding supporting post and the rotational shaft.

Further, a buffering cylinder is mounted between the base and the rotational shaft; an output end of the buffering cylinder is hinged to a middle part of the rotational shaft.

Further, one end of each of the supporting posts is formed with a passing hole in communication with an interior of the supporting post, and a corresponding wire passes through the passing hole; two ends of the rotational shaft are disposed with a first entrance and a second entrance; a first exit and a second exit is provided between the first entrance and the second entrance, where the first exit is more proximal to the first entrance than the second entrance, and the second exit is more proximal to the second entrance than the first entrance.

According to the above technical solutions, two seats are provided at two ends of the rotational shaft respectively corresponding to the two supporting posts respectively, and two pins are employed to fix the seats with the base so that a relative position between the rotational shaft and the base is fixed, and rotation is thus prevented. During use of the treadmill, the supporting posts and the handle bars will not easily shake or wobble, thereby improving the stability of the treadmill in its unfolded state.

DETAILED DESCRIPTION OF THE INVENTION

Figure 1:
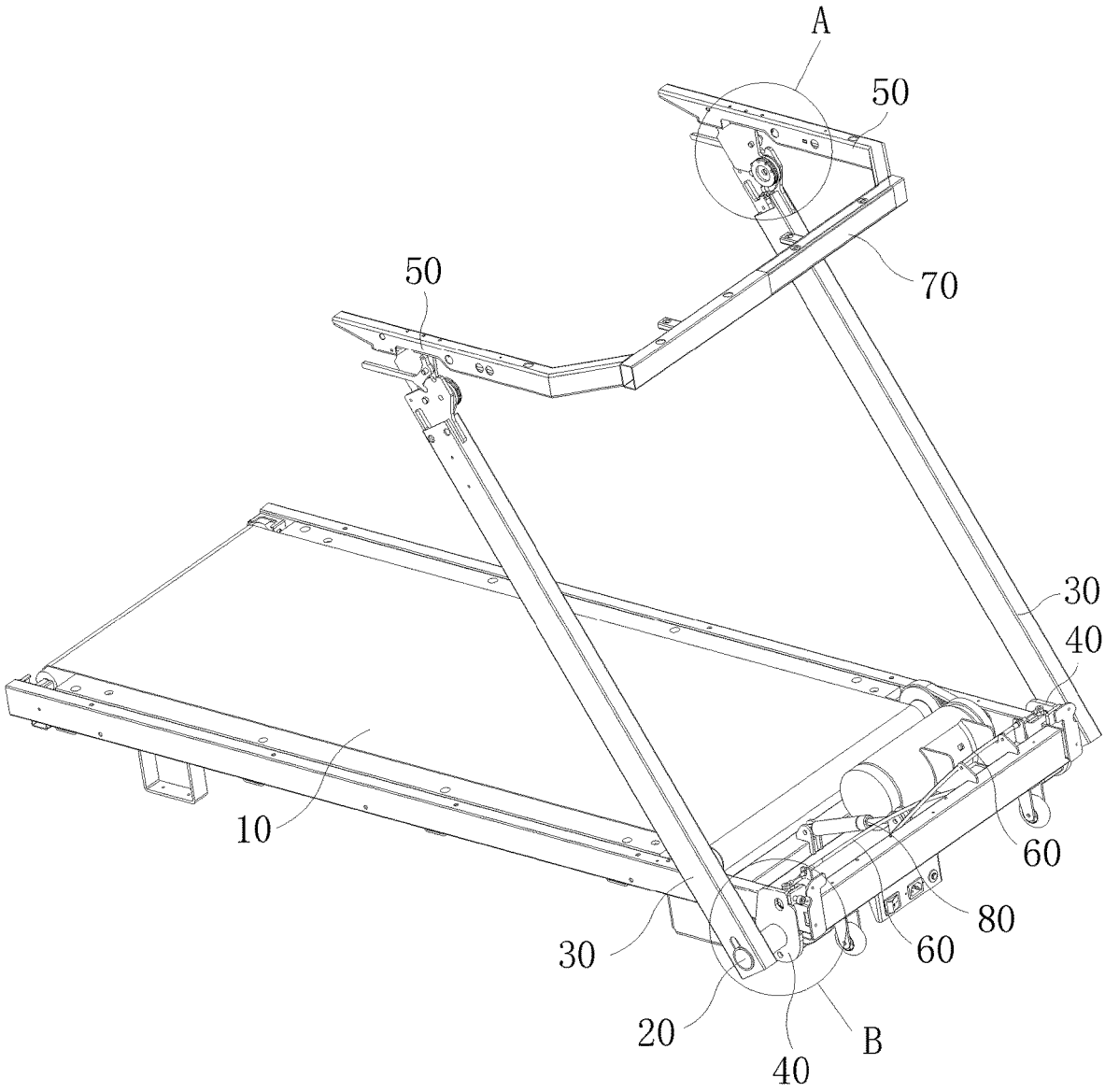
FIG. 1 is a perspective view of the present invention in an unfolded state according to an embodiment.

As shown in FIG. 1, the present invention provides a foldable treadmill, comprising a base 10, a rotational shaft 20, two supporting posts 30, two seats 40, two handle bars 50, and two sets of wire pulling mechanisms 60.

Figure 4:
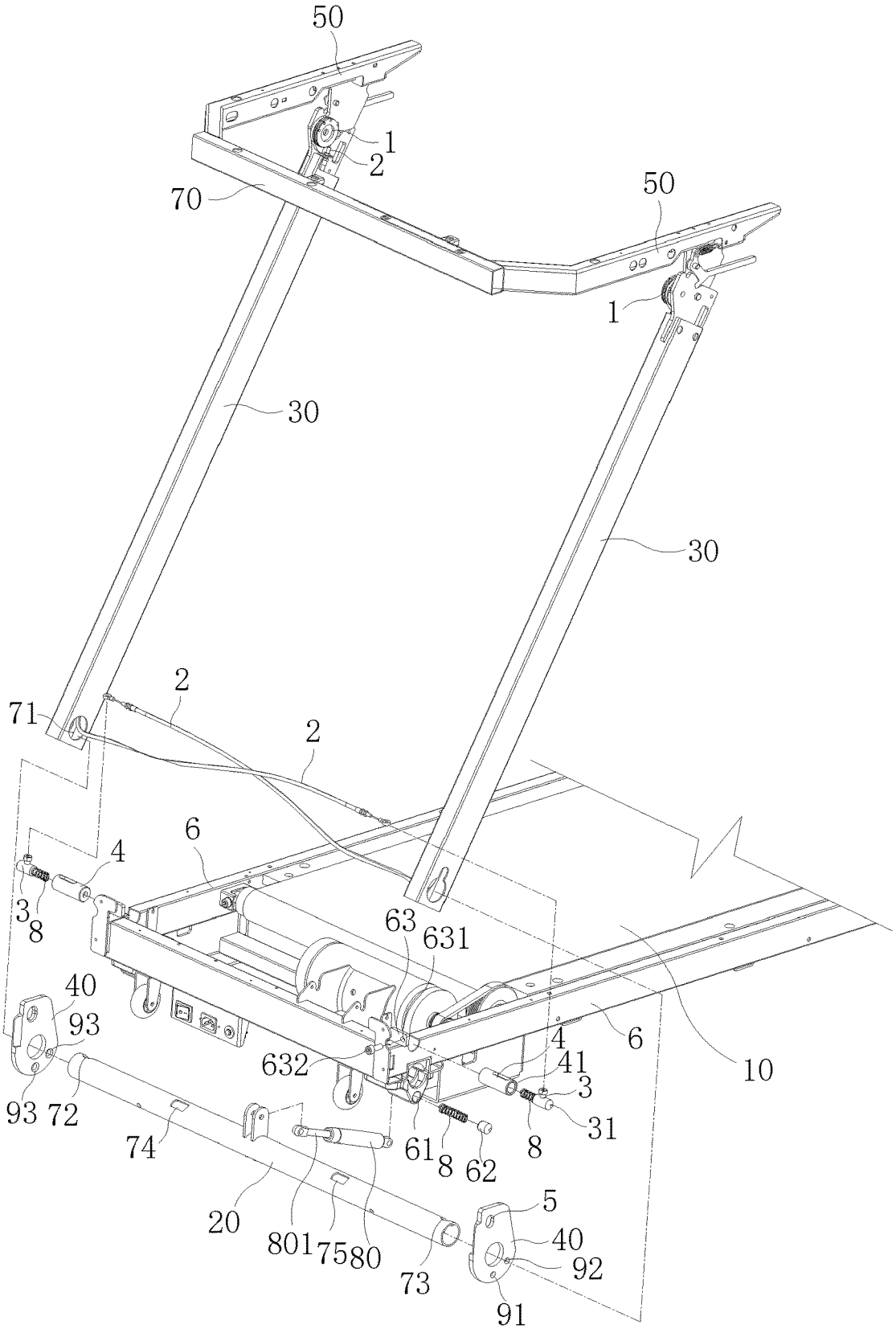
FIG. 4 is a partially exploded perspective view of the present invention according to an embodiment.

As shown in FIG. 4, the rotational shaft 20 is rotationally mounted at a frontal part of the base 10; the two supporting posts 30 are fixedly connected to two ends of the rotational shaft 20 respectively, and are also positioned on two sides of the base 10; the two seats 40 are fixedly connected to the rotational shaft 20 corresponding to the two supporting posts 30 respectively; each of the two seats 40 can be positioned between the base 10 and a corresponding supporting post 30; the two handle bars 50 are hinged with top ends of the two supporting posts 30 respectively; a frame 70 is connected between ends of the two handle bars 50 wherein said ends of the two handle bars 50 are oriented to a same direction.

Figure 2:
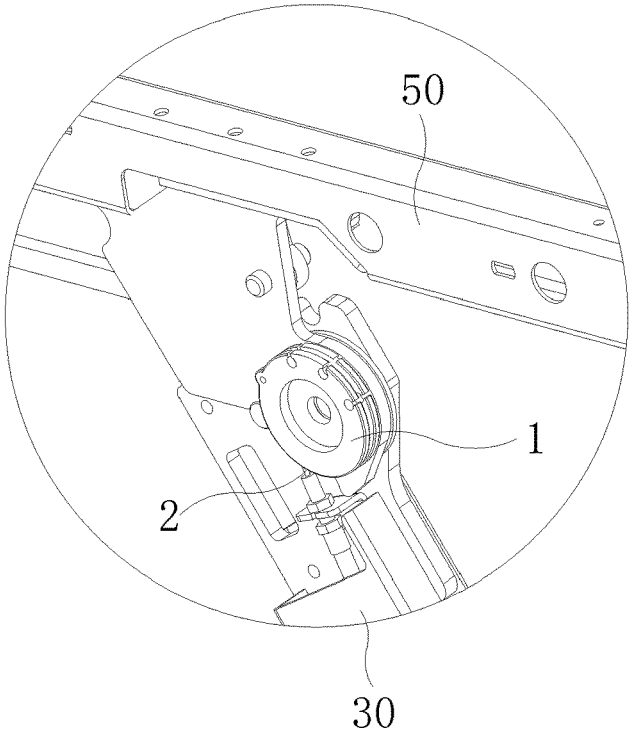
FIG. 2 is an enlarged view of portion A of FIG. 1.
Figure 3:
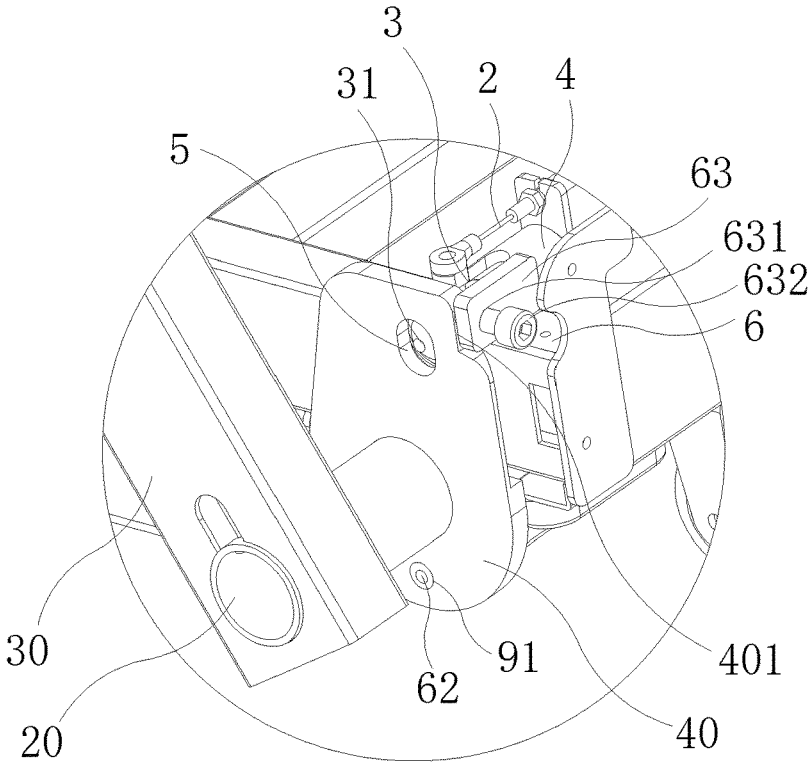
FIG. 3 is an enlarged view of portion B of FIG. 1.

With reference to FIG. 2 and FIG. 3, each of the two sets of wire pulling mechanisms 60 comprises a wheel 1, a wire 2, a pin 3, and a sleeve 4; each of the seats 40 is provided with a position limiting hole 5.

Two wheels 1 of the two sets of wire pulling mechanisms 60 are disposed on the two handle bars 50 respectively; the two wheels 1 rotate when the two handle bars 50 rotate; two sleeves 4 of the two sets of wire pulling mechanisms 60 are mounted on two side rods 6 at the two sides of the base 10 respectively; each sleeve 4 is formed with a through hole 41 which aligns with the position limiting hole 5 of a corresponding seat 40 when the treadmill is in an unfolded state; in each of the two sets of wire pulling mechanisms 60, the pin 3 is reciprocally slidable in the sleeve 4, and the pin 3 has a position limiting head 31 which is extendable out of the through hole 41 of the sleeve 4; two wires 2 of the two sets of wire pulling mechanisms 60 are steel wires; one end of the wire 2 of one of the two sets of wire pulling mechanisms 60 is connected to the wheel 1 of said one of the two sets of wire pulling mechanisms 60, and another end of the wire 2 of said one of the two sets of wire pulling mechanisms 60 is connected to the pin 3 of another one of the two sets of wire pulling mechanisms 60 slidably disposed in the sleeve 4 of said another one of the two sets of wire pulling mechanisms 60.

According to the present embodiment, rotation of the wheel 1 of one of the two sets of wire pulling mechanisms 60 can achieve more stable laterally driven linkage movement of the pin 3 of another one of the two sets of wire pulling mechanisms 60.

Each wire 2 may pass through thus being at least partially concealed within a corresponding supporting post 30 and the rotational shaft 20.

Figure 5:
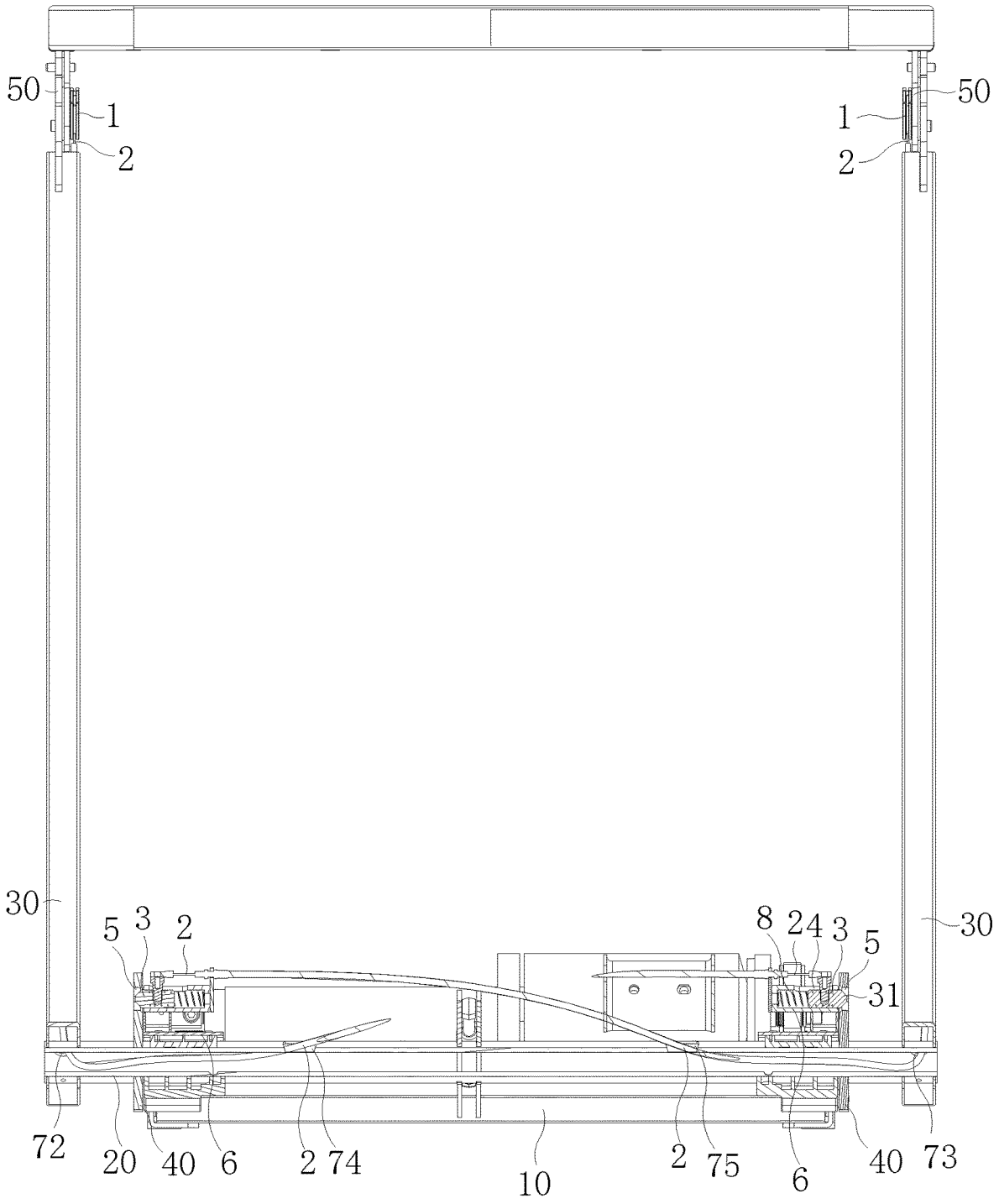
FIG. 5 is a sectional vie of the present invention according to an embodiment.

As shown in FIG. 4 and FIG. 5, one end of each of the supporting posts 30 is formed with a passing hole 71 in communication with an interior of the supporting post 30, and a corresponding wire 2 passes through the passing hole 71; two ends of the rotational shaft 20 are disposed with a first entrance 72 and a second entrance 73, a first exit 74 and a second exit 75 is provided between the first entrance 72 and the second entrance 73 where the first exit 74 is more proximal to the first entrance 72 than the second entrance 73, and the second exit 75 is more proximal to the second entrance 73 than the first entrance 72; the wire 2 of one of the two sets of wire pulling mechanisms 60 passes through the first entrance 72 into the rotational shaft 20 and exits from the first exit 74, whereas the wire 2 of another one of the two sets of wire pulling mechanisms 60 passes through the second entrance 73 into the rotational shaft 20 and exits from the second exit 75, so that interference between the two wires 2 can be minimized.

As shown in FIG. 1 and FIG. 3, when the supporting posts 30 and the handle bars 50 are unfolded, the position limiting head 31 of each pin 3 extends out of the through hole 41 of a corresponding sleeve 4 and into the position limiting hole 5 of a corresponding seat 40 fixed at a corresponding end of the rotational shaft 20, so that a relative position between the rotational shaft 20 and the base 10 is fixed, and no rotation will occur. Accordingly, the supporting posts 30 and the handle bars 50 will not easy shake and wobble, thereby improving the stability of the treadmill under an unfolded use state.

As shown in FIG. 4, in each of the two sets of wire pulling mechanisms 60, an elastic piece 8 such as a spring is disposed between the pin 3 and the sleeve 4, so as to provide biasing force for the position limiting head 31 of the pin 3 to extend into the position limiting hole 5 of a corresponding seat 40, such that the pin 3 is ensured to be always fixed with the corresponding seat 40 when the treadmill is unfolded.

Figure 6:
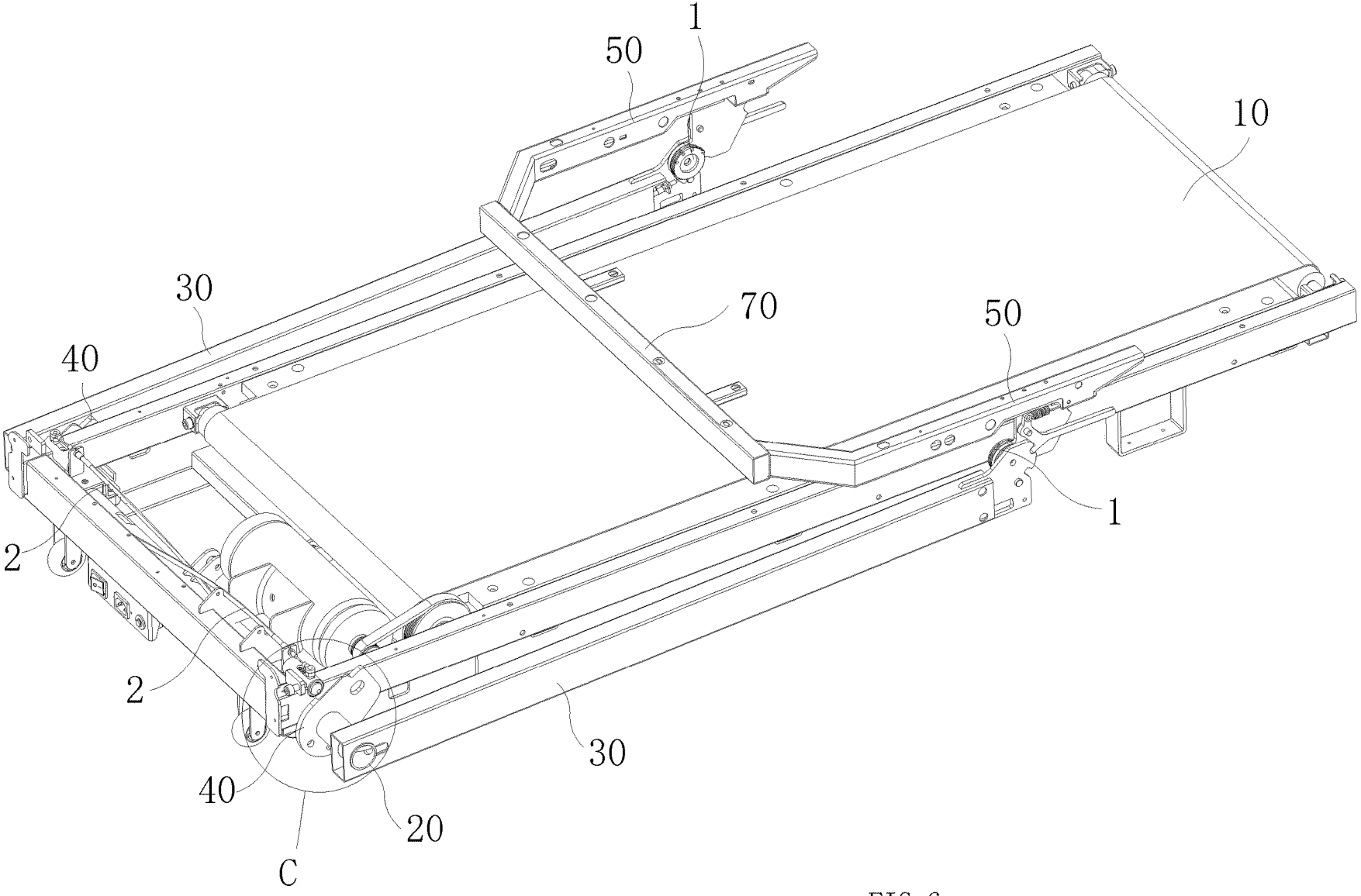
FIG. 6 a perspective view of the present invention in a folded state according to an embodiment.

As shown in FIG. 6, when it is required to fold the treadmill, the two handle bars 50 can be simultaneously rotated, wherein rotations of the handle bars 50 drive the wheels 1 to wind up the wires 2, and as the wires 2 are wound up, the pins 3 disposed at another ends of the wires 2 are pulled to slide within the sleeves 4 in a way that the position limiting heads 31 of the pins 3 are pulled to disengage from the position limiting holes 5 of the seats 40, thereby unlocking the rotational shaft 20 which is now enabled to freely rotate, such that the handle bars 50 and the supporting posts 30 can fall down due to gravity force and hence be folded against the base 10.

As shown in FIG. 1, a buffering cylinder 80 is mounted between the base 10 and the rotational shaft 20; an output end 801 of the buffering cylinder 80 is hinged to a middle part of the rotational shaft 20. When the handle bars 50 and the supporting posts 30 fall down and drive the rotational shaft 20 to rotate, rotation of the rotational shaft 20 can be buffered by the buffering cylinder 80 such that the handle bars 50 and the supporting posts 30 can fall down slowly and be folded against the base 10, thereby ensuring safety of use.

As shown in FIG. 4, at least one of the seats 40 is provided with an unfolded state positioning hole 91; a folded state positioning hole 92 is also disposed on one side of the unfolded state positioning hole 91; the unfolded state positioning hole 91 and the folded state positioning hole 92 are positioned on said at least one of the seats 40 at two points on a circular perimeter which has a center of circle being an axis of the rotational shaft 20. At least one of the two side rods 6 of the base 10 is provided with a fixing groove 61 corresponding to the unfolded state positioning hole 91; a positioning pin 62 is slidably disposed in the fixing groove 61; an outer end of the positioning pin 62 has a curved surface; another elastic piece 8 such as a spring is positioned between the fixing groove 61 and an inner end of the positioning pin 62 so as to provide a biasing force to bias the positioning pin 62 to move away from the fixing groove 61.

As shown in FIG. 3, the unfolded state positioning hole 91 is provided on said at least one of the seats 40 at a position corresponding to one side of the rotational shaft 20 where an opposite side of the rotational shaft 20 is disposed with the position limiting hole 5. In an unfolded state, the outer end of the positioning pin 62 is inserted into the unfolded state positioning hole 91 of said at least one of the seats 40, thereby assisting the position fixing effect of the seats 40 in addition to the pins 3 fixed within the position limiting holes 5, thus further improving stability.

Figure 7:
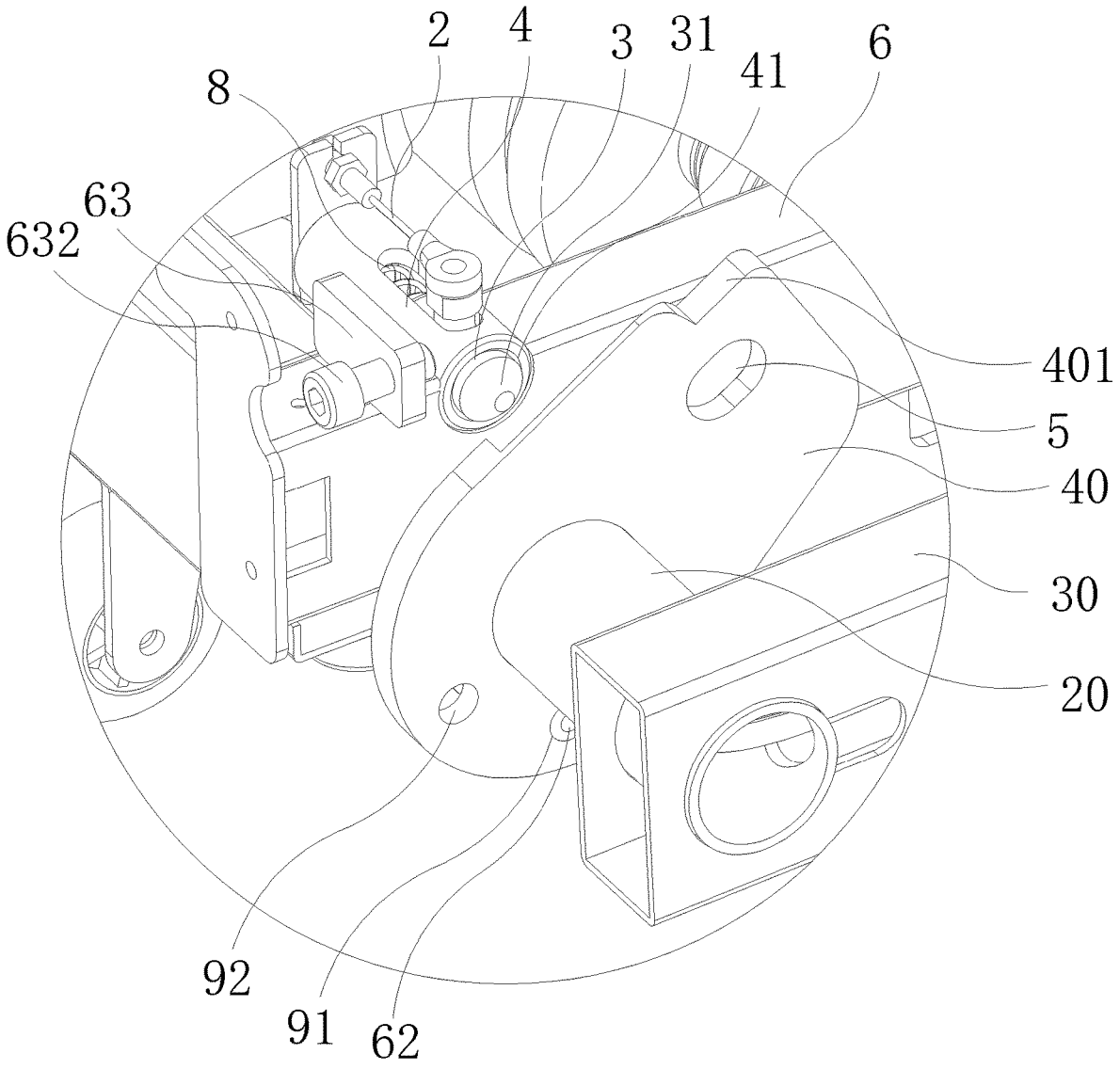
FIG. 7 is an enlarged view of portion C of FIG. 6.

As shown in FIG. 4, sides of the unfolded state positioning hole 91 and the folded state positioning hole 92 facing towards the positioning pin 62 are each provided with a guiding arc surface 93. As shown in FIG. 7, when folding the handle bars 50 and the supporting posts 30, the seats 40 will be driven to rotate; due to the curved surface at the outer end of the positioning pin 62 and a corresponding guiding arc surface 93 of the unfolded state positioning hole 91, the unfolded state positioning hole 91 can be easily disengaged from the positioning pin 62 as the seats 40 rotate, and rotation of the seats 40 will force the positioning pin 62 to retract into the fixing groove 61; as the seats 40 continue to rotate, the folded state positioning hole 92 will then align with the fixing groove 61, and the outer end of the positioning pin 62 will then be biased to extend out of the fixing groove 61 and insert into the folded state positioning hole 92 in order to fix a folded state of the treadmill, so that the handle bars 50 and the supporting posts 30 are ensured to be stable in a folded state.

As shown in FIG. 3 and FIG. 7, one side of at least one of the seats 40 facing towards a front side of the treadmill when the treadmill is in an unfolded state is provided with a limiting plane 401; the base 10 is provided with a limiting board 63. When unfolding the treadmill, rotation of the fixing seats 40 will cause the limiting plane 401 to come close and eventually abut against the limiting board 63 so as to prevent excessive rotation of the seats 40 and the rotational shaft 20.

Further, the limiting board 63 is provided with an adjustment hole 631; an adjustment screw 632 is threaded to the adjustment hole 631; one end of the adjustment screw 632 extends out of the adjustment hole 631 and is abuttable against the limiting plane 401. In case of machining deviation causing failure for the limiting plane 401 to precisely rest on the limiting board 63, the adjustment screw 62 can be rotated to adjust a length of the adjustment screw 62 extended out of the adjustment hole 631 to compensate the machining deviation.

Figure 8:
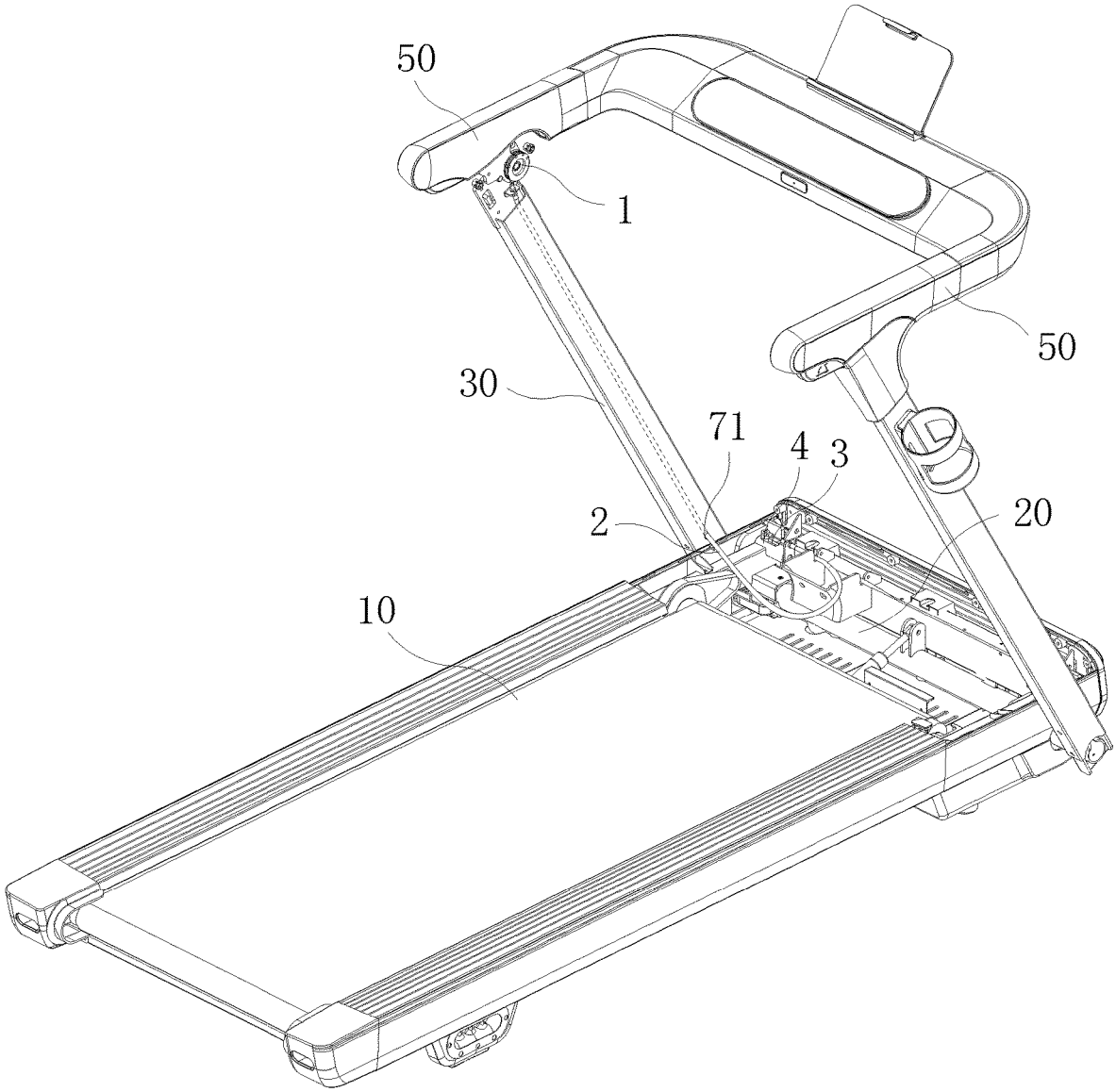
FIG. 8 is a perspective structural view of the present invention according to another embodiment.
Figure 9:
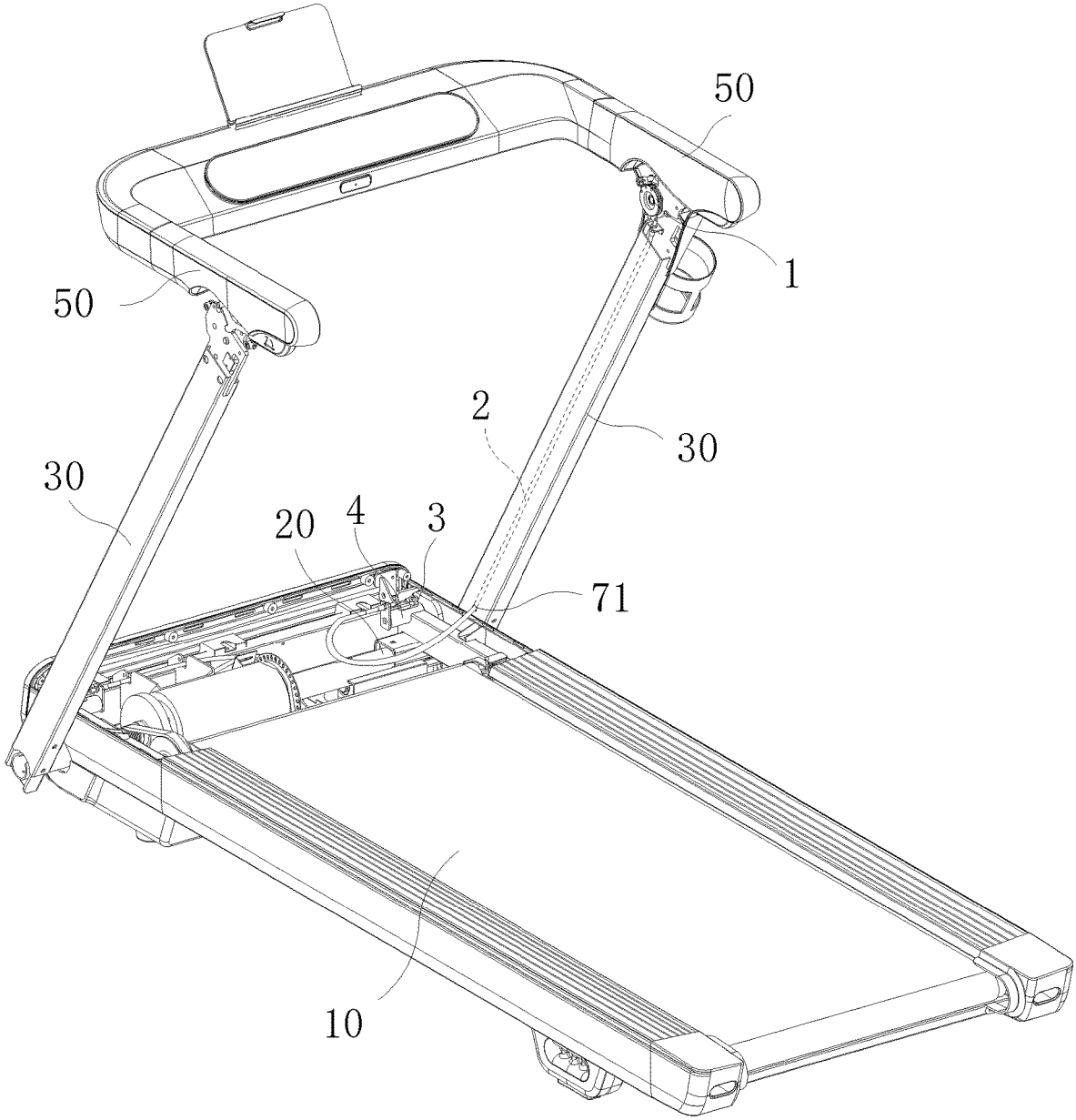
FIG. 9 is FIG. 8 illustrated from another viewing angle.

Another embodiment is shown in FIG. 8 and FIG. 9 where one end of the wire 2 of one of the two sets of wire pulling mechanisms 60 is connected to the wheel 1 of said one of the two sets of wire pulling mechanisms 60, and another end of the wire 2 of said one of the two sets of wire pulling mechanisms 60 is connected to the pin 3 of said one of the two sets of wire pulling mechanisms 60; also, one end of the wire 2 of another one of the two sets of wire pulling mechanisms 60 is connected to the wheel 1 of said another one of the two sets of wire pulling mechanisms 60, and another end of the wire 2 of said another one of the two sets of wire pulling mechanisms 60 is connected to the pin 3 of said another one of the two sets of wire pulling mechanisms 60.

Specifically, each wire 2 may pass through thus being at least partially concealed within a corresponding supporting post 30.

Each of the supporting posts 30 is formed with a passing hole 71 in communication with an interior of the supporting post 30, and a corresponding wire 2 passes through the passing hole 71; an upper end of the wire 2 of one of the two sets of wire pulling mechanisms 60 passing through one of the support posts 30 is connected to the wheel 1 of said one of the two sets of wire pulling mechanisms 60, and a lower end end of the wire 2 of said one of the two sets of wire pulling mechanisms 60 passing through said one of the support posts 30 is connected to the pin 3 of said one of the two sets of wire pulling mechanisms 60; also, an upper end of the wire 2 of another one of the two sets of wire pulling mechanisms 60 passing through another one of the support posts 30 is connected to the wheel 1 of said another one of the two sets of wire pulling mechanisms 60, and a lower end of the wire 2 of said another one of the two sets of wire pulling mechanisms 60 passing through said another one of the support posts 30 is connected to the pin 3 of said another one of the two sets of wire pulling mechanisms 60.

Accordingly, rotation of the wheels 1 wind up the wires 2, and as the wires 2 are wound up, the pins 3 disposed at another ends of the wires 2 are pulled to slide within the sleeves 4 to unlock the rotational shaft 20 which is now enabled to freely rotate, such that the handle bars 50 and the supporting posts 30 can fall down due to gravity force and hence be folded against the base 10.

Only the preferred embodiments of the present invention are described above. It should be noted that the scope of protection of the present invention should not be limited to the embodiments described above. Any other technical solutions in accordance with the teachings of the present invention should also fall within the scope of protection of the present invention.

What is claimed is:

1. A foldable treadmill, comprising a base, a rotational shaft, two supporting posts, and two handle bars; the rotational shaft is rotationally mounted at a frontal part of the base; the two supporting posts are fixedly connected to two ends of the rotational shaft respectively, and are also positioned on two sides of the base respectively; the two handle bars are hinged with top ends of the two supporting posts respectively; the two handle bars are foldable against the two supporting posts respectively, and the two supporting posts are foldable against the base; wherein:

the foldable treadmill also comprises two seats and two sets of wire pulling mechanisms;

the two seats are fixedly connected to the rotational shaft corresponding to the two supporting posts respectively;

the two sets of wire pulling mechanisms comprise two wires and two pins, wherein each of the two sets of wire pulling mechanisms comprises a wire of the two wires and a pin of the two pins; the two pins of the two sets of wire pulling mechanisms are movably disposed at two side rods of the two sides of the base respectively; one end of the wire of one of the two sets of wire pulling mechanisms disposed corresponding to one of the two sides of the base is connected to a corresponding handle bar disposed also corresponding to a same side as said one of the two sides of the base, and another end of the wire of said one of the two sets of wire pulling mechanisms disposed corresponding to said one of the two sides of the base is connected to a corresponding pin disposed also corresponding to the same side as said one of the two sides of the base or to a corresponding pin disposed corresponding to another one of the two sides of the base; rotation of the two handle bars to achieve folding of the treadmill drive the two wires to pull the two pins;

each of the two seats is provided with a position limiting hole which a corresponding pin is removably inserted, so that the two seats together with the rotational shaft achieve a fixed state or a rotatable state with respect to the base.

2. The foldable treadmill of claim 1, wherein one end of the wire of one of the two sets of wire pulling mechanisms disposed corresponding to a first side of the two sides of the base is connected to a corresponding handle bar disposed also corresponding to the first side of the two sides of the base, and another end of the wire of said one of the two sets of wire pulling mechanisms disposed corresponding to the first side of the two sides of the base is connected to a corresponding pin disposed also corresponding to the first side of the two sides of the base; and one end of the wire of another one of the two sets of wire pulling mechanisms disposed corresponding to a second side of the two sides of the base is connected to a corresponding handle bar disposed also corresponding to the second side of the two sides of the base, and another end of the wire of said another one of the two sets of wire pulling mechanisms disposed corresponding to the second side of the two sides of the base is connected to a corresponding pin disposed also corresponding to the second side of the two sides of the base.

3. The foldable treadmill of claim 1, wherein one end of the wire of one of the two sets of wire pulling mechanisms disposed corresponding to a first side of the two sides of the base is connected to a corresponding handle bar disposed also corresponding to the first side of the two sides of the base, and another end of the wire of said one of the two sets of wire pulling mechanisms disposed corresponding to the first side of the two sides of the base is connected to a corresponding pin disposed corresponding to a second side of the two sides of the base; and one end of the wire of another one of the two sets of wire pulling mechanisms disposed corresponding to the second side of the two sides of the base is connected to a corresponding handle bar disposed also corresponding to the second side of the two sides of the base, and another end of the wire of said another one of the two sets of wire pulling mechanisms disposed corresponding to the second side of the two sides of the base is connected to a corresponding pin disposed corresponding to the first side of the two sides of the base.

4. The foldable treadmill of claim 1, wherein the two sets of wire pulling mechanisms also comprise two wheels and two sleeves, wherein each of the two sets of wire pulling mechanisms comprises a wheel of the two wheels and a sleeve of the two sleeves; the two wheels of the two sets of wire pulling mechanisms are disposed on the two handle bars respectively; the two wheels rotate when the two handle bars rotate; one end of the wire of one of the two sets of wire pulling mechanisms is connected to the wheel of said one of the two sets of wire pulling mechanisms so that the wire is connected to a corresponding handle bar; the two sleeves of the two sets of wire pulling mechanisms are mounted on the two side rods of the two sides of the base respectively; each of the two sleeves is formed with a through hole which aligns with the position limiting hole of a corresponding seat when the treadmill is in an unfolded state; in each of the two sets of wire pulling mechanisms, the pin is reciprocally slidable in the sleeve, and the pin has a position limiting head which is extendable out of the through hole of the sleeve; in each of the two sets of wire pulling mechanisms, an elastic piece is disposed between the pin and the sleeve; the position limiting head of each pin extends out of the through hole of a corresponding sleeve and into the position limiting hole of the corresponding seat when the treadmill is in the unfolded state.

5. The foldable treadmill of claim 1, wherein at least one of the two seats is provided with an unfolded state positioning hole; at least one of the two side rods of the base is provided with a fixing groove corresponding to the unfolded state positioning hole; a positioning pin is slidably disposed in the fixing groove; an outer end of the positioning pin has a curved surface; an elastic piece is positioned between the fixing groove and an inner end of the positioning pin; when the treadmill is in an unfolded state, the outer end of the positioning pin is inserted into the unfolded state positioning hole.

6. The foldable treadmill of claim 5, wherein the unfolded state positioning hole is provided on said at least one of the two seats at a position corresponding to one side of the rotational shaft where an opposite side of the rotational shaft is disposed with the position limiting hole.

7. The foldable treadmill of claim 5, wherein a folded state positioning hole is also disposed on one side of the unfolded state positioning hole; the unfolded state positioning hole and the folded state positioning hole are positioned on said at least one of the two seats at two points on a circular perimeter which has a center of circle being an axis of the rotational shaft; when the treadmill is in a folded state, the folded state positioning hole is aligned with the fixing groove, so that the outer end of the positioning pin extends out of the fixing groove and inserts into the folded state positioning hole.

8. The foldable treadmill of claim 1, wherein one side of said at least one of the two seats facing towards a front side of the treadmill when the treadmill is in an unfolded state is provided with a limiting plane; the base is provided with a limiting board; when the treadmill is in an unfolded state, the limiting plane abuts against the limiting board; the limiting board is provided with an adjustment hole; an adjustment screw is threaded to the adjustment hole; one end of the adjustment screw extends out of the adjustment hole and is abuttable against the limiting plane.

9. The foldable treadmill of claim 1, wherein a buffering cylinder is mounted between the base and the rotational shaft; an output end of the buffering cylinder is hinged to a middle part of the rotational shaft.

10. The foldable treadmill of claim 1, wherein each of the two wires passes through thus being at least partially concealed within a corresponding supporting post and the rotational shaft.

11. The foldable treadmill of claim 10, wherein one end of each of the supporting posts is formed with a passing hole in communication with an interior of the supporting post, and a corresponding wire passes through the passing hole; two ends of the rotational shaft are disposed with a first entrance and a second entrance; a first exit and a second exit is provided between the first entrance and the second entrance, where the first exit is more proximal to the first entrance than the second entrance, and the second exit is more proximal to the second entrance than the first entrance.

12. The foldable treadmill of claim 3, wherein each of the two wires passes through thus being at least partially concealed within a corresponding supporting post and the rotational shaft.

13. The foldable treadmill of claim 12, wherein one end of each of the supporting posts is formed with a passing hole in communication with an interior of the supporting post, and a corresponding wire passes through the passing hole; two ends of the rotational shaft are disposed with a first entrance and a second entrance; a first exit and a second exit is provided between the first entrance and the second entrance, where the first exit is more proximal to the first entrance than the second entrance, and the second exit is more proximal to the second entrance than the first entrance.

* * * * *